United States Patent [19]

Sack

[11] 4,097,360

[45] Jun. 27, 1978

[54] QUENCHING PYROLYSIS REACTOR EFFLUENT STREAMS

[75] Inventor: Stuart Sack, Upland, Calif.

[73] Assignee: Occidental Petroleum Corporation, Los Angeles, Calif.

[21] Appl. No.: 700,047

[22] Filed: Jun. 25, 1976

[51] Int. Cl.[2] ..... C10G 11/02

[52] U.S. Cl. ..... 208/8; 208/11 R; 201/12; 201/14

[58] Field of Search ..... 208/8, 11 R; 201/12, 201/30, 14

[56] References Cited

U.S. PATENT DOCUMENTS

| | | | |
|---|---|---|---|
| 1,428,458 | 9/1922 | Thompson | 208/11 R |
| 2,982,701 | 5/1961 | Scott | 208/11 R |
| 3,058,903 | 10/1962 | Otis | 208/11 R |
| 3,297,562 | 1/1967 | Biddick et al. | 208/11 R |

*Primary Examiner*—Delbert E. Gantz
*Assistant Examiner*—James W. Hellwege
*Attorney, Agent, or Firm*—Christie, Parker & Hale

[57] ABSTRACT

A continuous process recovers values from a solid carbonaceous material by directly contacting a stream containing volatilized hydrocarbons resulting from the pyrolysis of the solid carbonaceous material with incoming feed carbonaceous material to quench the volatilized hydrocarbons, then pyrolyzing the carbonaceous material to yield a product stream containing volatilized hydrocarbons and a particulate residue.

16 Claims, 2 Drawing Figures

QUENCHING PYROLYSIS REACTOR EFFLUENT STREAMS

BACKGROUND OF THE INVENTION

Due to increasing scarcity of fluid fossil fuels such as oil and natural gas, much attention is being directed towards converting solid carbonaceous materials such as coal, oil shale, and solid waste to liquid and gaseous hydrocarbons by pyrolyzing the solid carbonaceous material. Typically the heat required for pyrolysis is obtained by oxidizing a carbon containing particulate residue of pyrolysis to carbon dioxide and water.

Since the combustion products of the carbon containing particulate residue are of little commercial value, it is desirable to minimize the amount of the carbon containing residue burned in order to maximize the thermal efficiency and overall yield of the pyrolysis process. It is also desirable to maximize the yield of the lighter gaseous hydrocarbons.

SUMMARY OF THE INVENTION

There is provided a process for recovery of values contained in a solid carbonaceous material which exhibits the above features; namely, high thermal efficiency, high overall yield, and high yield of light hydrocarbon products.

This process comprises the steps of directly contacting in a quench zone at least a portion of a feed stream containing a solid carbonaceous material with a stream containing hot volatilized hydrocarbons resulting from the pyrolysis of the solid carbonaceous material. Because the volatilized hydrocarbons are hotter than the carbonaceous material the volatilized hydrocarbons are quenched and the feed stream is preheated. Following this a stream containing preheated solid carbonaceous material is withdrawn from the quench zone and subjected to pyrolysis in a pyrolysis zone maintained at a temperature higher than the temperature in the quench zone by the feed of a particulate solid source of heat. The effluent pyrolysis product stream from the pyrolysis zone contains condensible and noncondensible volatilized hydrocarbons and a solids mixture of the carbon containing particulate solid residue and particulate source of heat. A volatilized hydrocarbon stream is separated in a separation zone from the solids mixture and at least a portion of this stream is passed to the quench zone to directly contact the carbonaceous material in the feed stream.

Values are also recovered by withdrawing at least a portion of the particulate residue and noncondensible hydrocarbons as product and by condensing condensible hydrocarbons.

This process exhibits high overall yield and high thermal efficiency because the solid carbonaceous material is preheated prior to pyrolysis by the volatilized hydrocarbons. Thus the energy contained in the volatilized hydrocarbon stream is recovered and recycled back to the pyrolysis zone. This means that less of the solid residue of pyrolysis has to be oxidized to provide the heat required for the endothermic pyrolysis reaction.

In one version of this invention, the quench zone is maintained at a temperature to condense a portion of the volatilized hydrocarbons in the quench zone to leave a residual uncondensed volatilized hydrocarbon stream. The condensed hydrocarbons are then recycled to the pyrolysis reaction zone to increase the yield of lighter noncondensible hydrocarbons by further thermal cracking.

This process is useful for such solid carbonaceous materials as oil shale, tar sands, agglomerative and nonagglomerative coals, and the organic fraction of solid waste. In the case of an agglomerative coal it is required that the temperature of the quench zone be maintained at a temperature to maintain the coal temperature below the softening point of the coal in order to prevent the coal particles from agglutinating.

These and other features, aspects and advantages of the present invention will become more apparent in the following drawings, detailed description of the invention and appended claims.

DRAWINGS

FIG. 1 schematically illustrates a process embodying features of this invention; and FIG. 2 shows another process embodying features of this invention.

DETAILED DESCRIPTION

Figure 1:
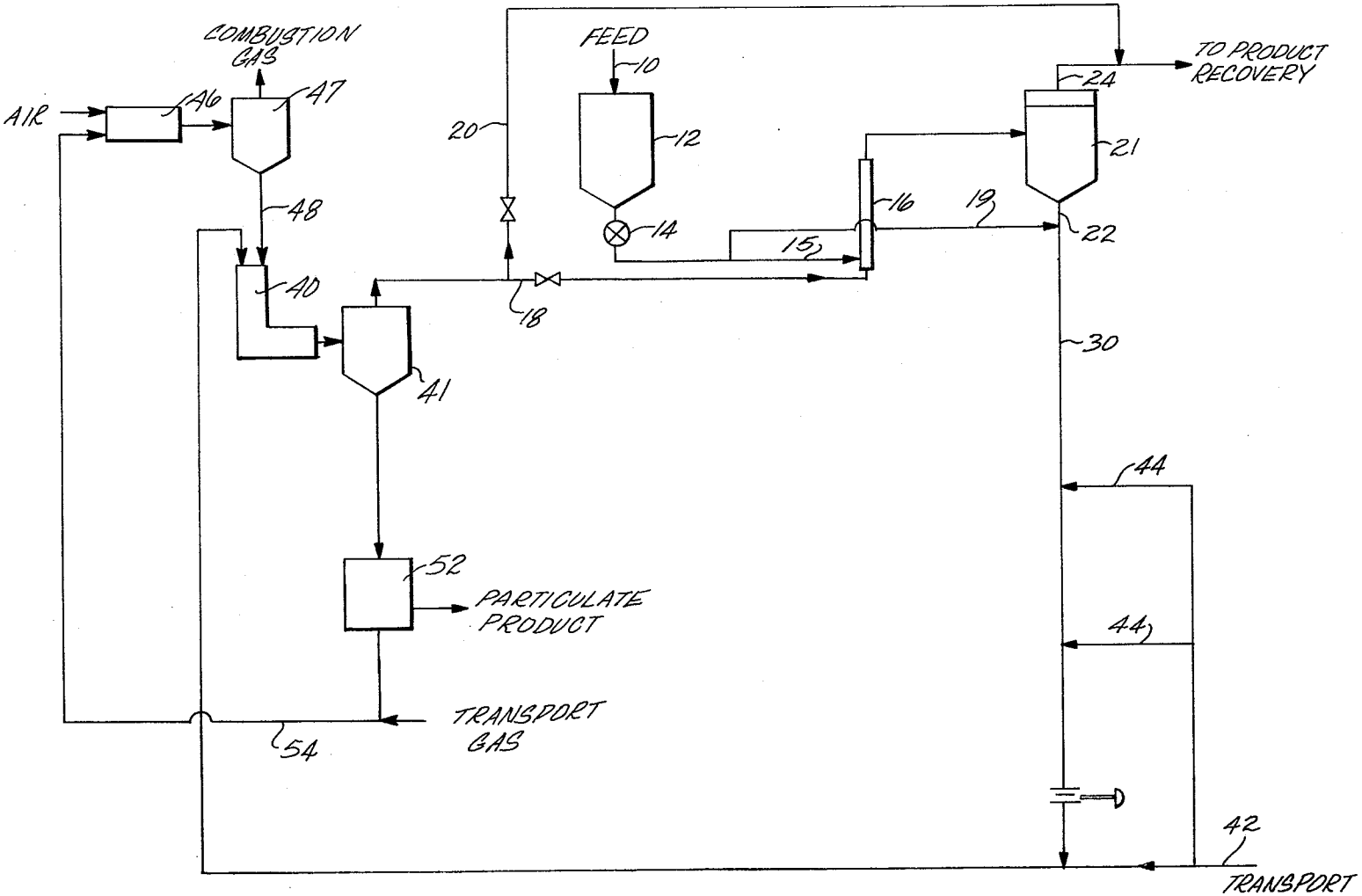

This invention is for a thermally efficient, continuous process for recovery of values contained in a solid carbonaceous material. Values are recovered by subjecting a stream containing preheated solid carbonaceous material to pyrolysis in a pyrolysis zone to yield a pyrolysis product stream which contains volatilized hydrocarbons and a particulate carbon containing residue. As used herein "pyrolysis" refers to a process which brings about a chemical change by the action of heat, and includes, but is not limited to, carbonization and coking with attendant liquefaction and/or gasification.

By the term "volatilized hydrocarbons" there is meant the hydrocarbon containing gases produced by pyrolysis of coal. In general these consist of condensible hydrocarbons in vapor and aerosol form which may be recovered by simply contacting the volatilized hydrocarbons with condensation means, and noncondensible gases such as methane and other hydrocarbon gases which are not recoverable by ordinary condensation means.

The carbonaceous materials which may be pyrolyzed in accordance with the present invention include solids such as agglomerative coals, nonagglomerative coals, tar sands, the organic residue of the treatment of solid wastes and the like. The carbonaceous material should be flowable into the reactor alone or with the aid of a carrier gas. For solids, the ideal particle size is from about 20 to about 1000 microns, preferably from 50 to about 300 microns.

Pyrolysis of such material is carried out at a temperature above 600° F. Since gasification is the primary object of this process, it is preferred that pyrolysis occurs at temperatures from about 1400° to about 1750° F or greater up to the temperature at which the inorganic portion of the solid carbonaceous material softens with resultant slag formation. The method of this invention can also be used where liquification is the primary objective of the process.

Whatever the pyrolysis temperature, there are contained in the volatilized hydrocarbons condensible and noncondensible hydrocarbons. Although some tars are formed and normally noncondensible hydrocarbons, the primary products to be obtained are $C_5$ and lighter hydrocarbons. These hydrocarbons are most used for fuel gas. To maximize their formation pyrolysis contact times may range up to about 5 seconds, and preferably are from about 0.1 to about 3 seconds.

Higher overall yields are obtained in accordance with this invention by preheating at least a portion of the solid carbonaceous material in a quench zone in which the solid carbonaceous material is directly contacted with a stream containing volatilized hydrocarbons resulting from the pyrolysis of the solid carbonaceous material. This contacting step in the quench zone not only preheats the carbonaceous material, but also can condense a portion of the higher boiling point heavier fraction of the volatilized hydrocarbons or tars. A stream containing the preheated solid carbonaceous material and any condensed volatilized hydrocarbons is separated from the uncondensed volatilized hydrocarbons, and is then subjected to pyrolysis in a pyrolysis reaction zone which is maintained at a temperature higher than the temperature in the quench zone. In the pyrolysis reaction zone a pyrolysis product stream containing the condensible and noncondensible volatilized hydrocarbons and the particulate carbon containing residue is formed as a consequence of heat transferred from a particulate solid source of heat normally transported to the pyrolysis reactor by carrier gas which is nondeleteriously reactive with respect to the products of pyrolysis. Where any particulate source of heat may be used, for convenience the particulate source of heat is preferably formed by partial combustion of the particulate carbon containing solid product of pyrolysis, normally char.

Because at least a portion of the solid carbonaceous material is preheated in a quench zone before pyrolysis, the process heat contained in the volatilized hydrocarbons is recovered. Therefore less of the solid carbon containing residue of pyrolysis needs to be consumed into ash and the relatively valueless byproducts of carbon dioxide and water vapor to provide the heat required for the pyrolysis reaction.

Another advantage of this process can result if at least a portion of the heavier hydrocarbons is condensed in the quench zone and recycled to the pyrolysis reaction zone. In the pyrolysis reaction zone. In the pyrolysis reaction zone some of these heavier hydrocarbons are cracked to yield lighter hydrocarbons which are more valuable than the heavier tars initially produced by pyrolysis.

The use of a carrier gas which is nondeleteriously reactive with respect to the products of pyrolysis means a gas essentially free of oxygen but which may contain constituents such as hydrogen which upgrade or stabilize products of pyrolysis. To be avoided are constituents which degrade pyrolysis products.

The temperature in the pyrolysis zone is determined by the introduction temperature of the particulate solid source of heat. Generally from 2 to about 20 pounds of the particulate solid source of heat per pound of the solid carbonaceous material are utilized to achieve the desired pyrolysis temperatue. Normally the particulate solid source of heat is introduced at a temperature from about 100° to about 500° F above the desired pyrolysis temperature.

As indicated the quench zone can be operated at a temperature which will selectively cause the heavier tars to condense in the carbonaceous materials to enable their recycle to the pyrolysis zone.

This, however, is not applicable when recovering values from agglomerative coal. It is well known that agglomerative coals have a tendency to plasticize and then agglutinate at relatively low temperatures, i.e., from about 300° to 700° F. For agglomerative coals it is important that the temperature of the coal be maintained less than its softening point. As used herein the term "softening point" refers to the temperature at which the resistance of the coal to a Davis plastometer increases, as described in *Chemistry of Coal Utilization* by H. H. Lowry (John Wiley & Sons, Inc. 1963) page 161. As a consequence some of the lighter hydrocarbons may condense on the particle surface and be recycled to the pyrolysis zone.

Referring now to FIG. 1, a feed stream 10 containing a solid carbonaceous material is fed to a storage bin or hopper 12. The carbonaceous material may be treated before it is fed to the feed bin by processes such as removal of inorganic fractions by magnetic separation and classification, particulary in the case of municipal solid waste. The solid carbonaceous material can optionally be fully dried or partially dried. The carbonaceous material is preferably partially dried to avoid the expenditure of heat energy for heating and vaporizing water in the pyrolysis zone. The carbonaceous material is pulverized to present a large surface to volume ratio to obtain rapid heating in the pyrolysis reaction. The carbonaceous material feed is at least 80% minus (−) 60 mesh (Tyler standard mesh), preferably at least 80% −100 mesh with the remainder passing −60 mesh. However, the carbonaceous feed can be ground to finer mesh sizes, such as −200 mesh to provide faster heat transfer and faster pyrolysis times.

A portion of the solid carbonaceous material in the storage hopper 12 is pneumatically conveyed, or alternatively fed by gravity flow through a rotary valve 14 or other feed regulating means, through line 15 from the storage hopper 12 into a quench zone 16. In the quench zone 16 the solid carbonaceous material is directly contacted with a gaseous stream 18 containing carrier gas and volatilized hydrocarbons resulting from pyrolysis of the solid carbonaceous material. This serves to simultaneously cool the volatilized hydrocarbons, preheat the solid carbonaceous material, and if the temperature in the quench zone is sufficiently low, condense a portion of the volatilized hydrocarbons. Preferably the flow in the quench zone 16 is turbulent to ensure intimate contact between the solid particles and the volatilized hydrocarbons.

Direct contact heat exchange occurs in the quench zone between volatilized hydrocarbons and the cold carbonaceous feed material with the resultant equilibrium temperature of the mixture depending upon the mass ratio of the gas to solid stream and the temperatures of both streams. The equilibrium temperature in the quench zone 16 is adjusted as might be required by the agglomeration properties of the carbonaceous material, the characteristics of the volatilized hydrocarbons, or for optimization of gas or liquid yields from the process. Higher temperatures can be obtained by bypassing a portion of the particulate feed stream around the quench step via line 19. Lower temperatures can be obtained by diverting part of the hot volatilized hydrocarbons around the quench zone via line 20.

Exemplary of flow configurations useful for directly contacting volatilized hydrocarbons with carbonaceous feed for rapid quenching of the hydrocarbons include cocurrent entrained flow, concurrent flow in fast and dense type fluidized beds, and countercurrent flow.

The contents of the quench zone 16 flow into a cyclone 21 in which a stream 22 containing the preheated solid carbonaceous material and condensed volatilized hydrocarbons is separated from a stream 24 containing the residual uncondensed volatilized hydrocarbons and other components of the pyrolysis product gas stream. The residual uncondensed volatilized hydrocarbon stream 24 and the portion of the product gas stream in line 20 not fed to the quench zone 16 are sent to subsequent processing which may consist of a second stage cyclone for recovery of entrained particulate matter, followed by conventional separation recovery means for separating values contained therein. This can consist of contacting the volatilized hydrocarbons with a liquid stream containing condensed. hydrocarbons generated in the pyrolysis reaction zone to condense the heavier tar portion of the volatilized hydrocarbons, and then passing the tars into the pyrolysis reaction zone in which they are cracked to produce valuable lighter hydrocarbons.

The preheated solid carbonaceous material and condensed volatilized hydrocarbon stream 22 is combined with that portion of the carbonaceous feed material in line 19 not fed to the quench zone 16. The combined stream flows down a standpipe 30 to a pyrolysis reaction zone 40. A transport or carrier gas stream 42 which is nondeleteriously reactive with respect to pyrolysis reaction products is used to convey the solid carbonaceous material and condensed volatilized hydrocarbons to the pyrolysis reaction zone. A portion of the transport gas is used for aeration injection into the standpipe 30 at multiple locations 44 as required to maintain steady flow in the standpipe. Preferably the scrubbed gases resulting from condensing the condensible volatilized hydrocarbons and removing undesirable gaseous products from the product gas stream from the pyrolysis reactor are utilized as the transport gas stream 42.

The preheated solid carbonaceous material and condensed volatilized hydrocarbons are introduced into the pyrolysis reaction zone 40 and are subjected to pyrolysis to yield a pyrolysis product stream containing condensible and noncondensible volatilized hydrocarbons and a carbon containing particulate solid residue by contact with a particulate solid source of heat introduced with an essentially oxygen free transport or carrier gas. Preferably turbulent flow is maintained in the pyrolysis reactor to insure good heat transfer characteristics. The particulate solid source of heat is transported through line 48 and combined with the solid carbonaceous material at the inlet to the pyrolysis zone 40. Steam can be introduced into the pyrolysis reactor to increase the amount of fuel gas produced.

The pyrolysis product stream passes from the pyrolysis zone 40 to a pyrolysis product separation zone such as cyclone separator 41. In the pyrolysis product separation zone 41 the solid carbon containing residue of pyrolysis is separated from the vapor stream, i.e., carrier gas plus pyrolytic vapors containing volatilized hydrocarbons.

The solids separated from the vapors exit at the base of the cyclone 41 and pass to a storage bin 52. A portion is recovered as product 52 and the balance transported through line 54 with a transport gas to a combustion zone 46. In the combustion zone 46, at least a portion of the carbon containing solid residue of pyrolysis is at least partially oxidized in the presence of a source of oxygen such as air to form the particulate source of heat and combustion gases. Exothermic combustion of carbon in the carbon containing solid residue generates the heat required to raise the particulate solid source of heat to the temperature required for pyrolysis. The particulate source of heat with its combustion gases and any unreacted portion of the source of oxygen pass from the combustion zone to a separator such as combustion zone cyclone separator 47. In the separator 47, the particulate source of heat and any ash formed in the combustion zone due to complete oxidation of carbon containing solid residue of pyrolysis are separated from the combustion gases. The combustion gases pass out the top of the cyclone 47 and the solids exit the base of combustion zone cyclone 47 and are conveyed in line 48 by a carrier gas which may be an oxygen free flue gas to the pyrolysis zone 40.

At least a portion of the volatilized hydrocarbons, which are discharged out the top of the pyrolysis reactor cyclone separator 41, are passed along line 18 to the quench zone 16 to directly contact solid carbonaceous material in the feed stream. Both the pyrolysis reaction zone 40 and the combustion zone 46 are preferably lower in elevation than the cyclone 21 after the quench zone in order to establish the required pressure differential for proper solids circulation from the cyclone 21 after the quench zone through the reactor 40 to the combustion zone 46.

Figure 2:
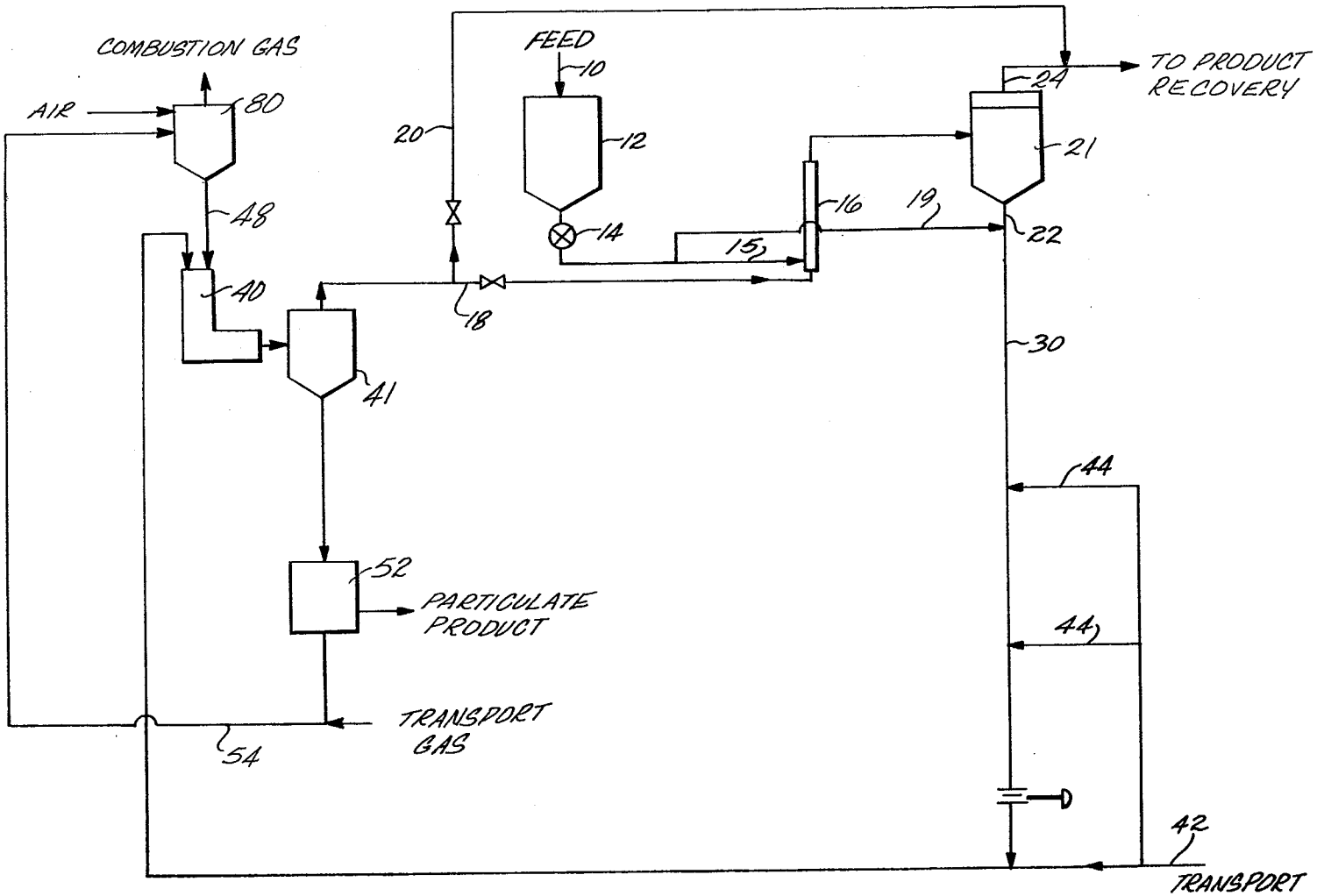

FIG. 2 represents a version of this invention which differs from the version shown in FIG. 1 in that the carbon containing solid residue is oxidized and the resulting particulate source of heat is separated from the flue gas simultaneously in a single cyclone combustion separation zone 80. This change results in significant advantages. Among these advantages are reduced capital and operating costs for the process because a separator and an apparatus for a combustion zone can be replaced with just one cyclone. In addition, production of carbon monoxide is minimized because short reaction times are obtainable by using a cyclone vessel for oxidizing the carbon containing solid residue. This results in high thermal efficiency of the process. It is preferred that the residence times of solids in the cyclone combustion separator 80 be less than about 5 seconds, and more preferably, less than about 1 second. These short residence times favor production of carbon dioxide compared to carbon monoxide. In general, it is preferred that the size of the combustion zone be minimized to minimize the residence time of the carbon containing solid residue in the zone and thus minimize carbon monoxide production. Elimination of a separate combustion zone in the version of this invention shown in FIG. 2 is the ultimate result of this concept.

Although the invention has been described in terms of a pyrolysis process where the heat for pyrolysis is obtained by oxidizing a portion of the solid carbonaceous material, this invention also contemplates processes where the heat for pyrolysis is obtained externally such as by indirect electric heating or steam heating of a jacketed pyrolysis reactor. The advantages of this invention are still realized in this type of process since less external heating for the reaction zone is required because the solid carbonaceous material enters the pyrolysis reactor zone preheated. Also, pyrolysis reaction zone configurations other than the tubular descending flow reactor shown in the Drawing may be used.

Because of variations such as these, the spirit and scope of the appended claims should not necessarily be limited to the description of the preferred embodiments.

What is claimed is:

1. A continuous process for recovery of values contained in a feed stream containing a solid carbonaceous material comprising the steps of:

(a) directly contacting under turbulent flow conditions in a cocurrent, entrained flow quench zone at least a portion of the feed stream with a stream containing volatilized hydrocarbons resulting from pyrolysis of the solid carbonaceous material to simultaneously preheat the feed stream and rapidly quench the volatilized hydrocarbons;

(b) separating a stream containing the preheated solid carbonaceous material from the volatilized hydrocarbons;

(c) pyrolyzing the stream containing preheated solid carbonaceous material in a pyrolysis zone maintained at a temperature higher than the temperature of the quench zone by contact with a particulate solid source of heat to yield a pyrolysis product stream containing condensible volatilized hydrocarbons and a carbon containing particulate solid residue;

(d) separating volatilized hydrocarbons from the carbon containing particulate solid residue;

(e) passing at least a portion of the separated volatilized hydrocarbons to the quench zone to directly contact carbonaceous material in the feed stream;

(f) withdrawing at least a portion of the carbon containing particulate solid residue as product; and (g) separating values from the volatilized hydrocarbons by condensing hydrocarbons therefrom.

2. A process as claimed in claim 1 in which the temperature of the quench zone is maintained to condense a portion of the volatilized hydrocarbons in the quench zone.

3. A process as claimed in claim 1 in which the feed stream has a particle size of from about 20 to about 1000 microns.

4. A continuous process for recovery of values contained in a feed stream containing a solid carbonaceous material comprising the steps of:

(a) directly contacting under turbulent flow conditions in a cocurrent, entrained flow quench zone at least a portion of the feed stream with a stream containing volatilized hydrocarbons resulting from pyrolysis of the solid carbonaceous material to simultaneously preheat the feed stream and condense a portion of the volatilized hydrocarbons;

(b) separating a stream containing the preheated solid carbonaceous material and the condensed volatilized hydrocarbons from the uncondensed volatilized hydrocarbons, thereby leaving a residual uncondensed volatilized hydrocarbon stream;

(c) subjecting the stream containing preheated solid carbonaceous material and condensed volatilized hydrocarbons to pyrolysis in a pyrolysis zone maintained at a temperature higher than the temperature of the quench zone by contact with a particulate solid source of heat to yield a pyrolysis product stream containing condensible and non-condensible volatilized hydrocarbons and a solids mixture of a carbon containing particulate solid residue and the particulate source of heat;

(d) passing the pyrolysis product stream to a separation zone for separating volatilized hydrocarbons from the solids mixture;

(e) passing at least a portion of the separated volatilized hydrocarbons to the quench zone to directly contact solid carbonaceous material in the feed stream;

(f) withdrawing at least a portion of the carbon containing particulate solid residue as product; and (g) separating values from the residual uncondensed volatilized hydrocarbon stream by condensing hydrocarbons therefrom.

5. A process as claimed in claim 4 comprising the additional step of subjecting at least a portion of the separated mixture of the carbon containing particulate residue of pyrolysis and the particulate solid source of heat to partial oxidation in the presence of a source of oxygen to form the particulate source of heat for feed to the pyrolysis reaction zone.

6. In a continuous process for recovery of values contained in a feed stream containing a solid carbonaceous material in which a stream containing preheated solid carbonaceous material is pyrolyzed in a pyrolysis zone by contact with a particulate solid source of heat to yield a pyrolysis product stream containing condensible volatilized hydrocarbons and a carbon containing particulate solid residue; the improvement which comprises the step of:

directly combining in cocurrent, entrained, turbulent flow in a quench zone maintained at a temperature lower than the temperature in the pyrolysis zone at least a portion of the feed stream with a stream containing volatilized hydrocarbons resulting from pyrolysis of the solid carbonaceous material to simultaneously preheat the feed stream and rapidly quench the volatilized hydrocarbons.

7. A process as claimed in claim 6 in which the temperature of the quench zone is maintained to condense a portion of the volatilized hydrocarbons in the quench zone.

8. A continuous process for recovery of values contained in a feed stream containing an agglomerative solid carbonaceous material comprising the steps of:

(a) directly combining in turbulent flow in a quench zone maintained at a temperature less than the softening point of the agglomerative solid carbonaceous material at least a portion of the feed stream with a stream containing volatilized hydrocarbons resulting from pyrolysis of the agglomerative solid carbonaceous material to simultaneously preheat the feed stream and quench the volatilized hydrocarbons;

(b) separating a stream containing the preheated agglomerative solid carbonaceous material from volatilized hydrocarbons;

(c) pyrolyzing the stream containing preheated agglomerative solid carbonaceous material in a pyrolysis zone maintained at a temperature higher than the temperature of the quench zone by contact with a particulate solid source of heat to yield a pyrolysis product stream containing condensible volatilized hydrocarbons and a carbon containing particulate solid residue;

(d) separating volatilized hydrocarbons from the carbon containing particulate solid residue;

(e) passing at least a portion of the separated volatilized hydrocarbons to the quench zone to directly contact agglomerative solid carbonaceous material in the feed stream;

(f) withdrawing at least a portion of the carbon containing particulate solid residue as product; and (g) separating values from the volatilized hydrocarbons by condensing hydrocarbons therefrom.

9. A process as claimed in claim 8 in which the temperature of the quench zone is maintained to condense a portion of the volatilized hydrocarbons in the quench zone.

10. A continuous process for recovery of values contained in a feed stream containing an agglomerative coal comprising the steps of:

(a) directly contacting in a quench zone maintained at a temperature less than the softening point of the agglomerative coal at least a portion of the feed stream with a stream containing volatilized hydrocarbons resulting from pyrolysis of the agglomerative coal to simultaneously preheat the feed stream and condense a portion of the volatilized hydrocarbons;

(b) separating a stream containing the preheated agglomerative coal and the condensed volatilized hydrocarbons from the uncondensed volatilized hydrocarbons, thereby leaving a residual uncondensed volatilized hydrocarbon stream;

(c) subjecting the stream containing preheated agglomerative coal and condensed volatilized hydrocarbons to pyrolysis in a pyrolysis zone maintained at a temperature higher than the temperature of the quench zone by contact with a particulate solid source of heat to yield a pyrolysis product stream containing condensible and noncondensible volatilized hydrocarbons and a solids mixture of the carbon containing particulate solid residue and the particulate source of heat;

(d) passing the pyrolysis product stream to a separation zone for separating volatilized hydrocarbons from the solids mixture;

(e) passing at least a portion of the separated volatilized hydrocarbons to the quench zone to directly contact agglomerative coal in the feed stream;

(f) withdrawing at least a portion of the carbon containing particulate solid residue as product; and (g) separating values from the residual uncondensed volatilized hydrocarbon stream by condensing hydrocarbons therefrom.

11. A process as claimed in claim 10 comprising the additional step of subjecting at least a portion of the separated mixture of the carbon containing particulate residue and the particulate solid source of heat to partial oxidation in the presence of a source of oxygen to form the particulate source of heat for feed to the pyrolysis reaction zone.

12. In a continuous process for recovery of values contained in a feed stream containing an agglomerative solid carbonaceous material in which a stream containing preheated agglomerative solid carbonaceous material is pyrolyzed in a pyrolysis zone by contact with a particulate solid source of heat to yield a pyrolysis product stream containing condensible volatilized hydrocarbons and a carbon containing particulate solid residue of the agglomerative solid carbonaceous material; the improvement which comprises the step of:

directly conbining in turbulent flow in a quench zone maintained at a temperature lower than the temperature in the pyrolysis zone and at a temperature less than the softening point of the agglomerative solid carbonaceous material at least a portion of the feed stream with a stream containing volatilized hydrocarbons resulting from pyrolysis of the agglomerative solid carbonaceous material to simultaneously preheat the feed stream and quench the volatilized hydrocarbons.

13. A process as claimed in claim 12 in which the temperature of the quench zone is maintained to condense a portion of the volatilized hydrocarbons in the quench zone.

14. A continuous process for recovery of values contained in a feed stream containing an agglomerative coal comprising the steps of:

(a) directly contacting under turbulent flow conditions in a cocurrent, entrained flow quench zone maintained at a temperature less than the softening point of the agglomerative coal at least a portion of the feed stream with a stream containing volatilized hydrocarbons resulting from pyrolysis of the agglomerative coal to simultaneously preheat the feed stream and rapidly quench the volatilized hydrocarbons;

(b) separating a stream containing the preheated agglomerative coal from the volatilized hydrocarbons;

(c) pyrolyzing the stream containing preheated agglomerative coal in a pyrolysis zone maintained at a temperature higher than the temperature of the quench zone by contact with a particulate solid source of heat to yield a pyrolysis product stream containing condensible volatilized hydrocarbons and a carbon containing particulate solid residue;

(d) separating volatilized hydrocarbons from the carbon containing particulate solid residue;

(e) passing at least a portion of the separated volatilized hydrocarbons to the quench zone to directly contact agglomerative coal in the feed stream;

(f) withdrawing at least a portion of the carbon containing particulate solid residue as product; and (g) separating values from the volatilized hydrocarbons by condensing hydrocarbons therefrom.

15. A continuous process for recovery of values contained in a feed stream containing an agglomerative coal comprising the steps of:

(a) directly contacting under turbulent flow conditions in a cocurrent, entrained flow quench zone maintained at a temperature less than the softening point of the agglomerative coal at least a portion of the feed stream with a stream containing volatilized hydrocarbons resulting from pyrolysis of the agglomerative coal to simultaneously preheat the feed stream and condense a portion of the volatilized hydrocarbons;

(b) separating a stream containing the preheated agglomerative coal and the condensed volatilized hydrocarbons from the uncondensed volatilized hydrocarbons, thereby leaving a residual uncondensed volatilized hydrocarbon stream;

(c) subjecting the stream containing preheated agglomerative coal and condensed volatilized hydrocarbons to pyrolysis in a pyrolysis zone maintained at a temperature higher than the temperature of the quench zone by contact with a particulate solid source of heat to yield a pyrolysis product stream containing condensible and noncondensible volatilized hydrocarbons and a solids mixture of a carbon containing particulate solid residue and the particulate source of heat;

(d) passing the pyrolysis product stream to a separation zone for separating volatilized hydrocarbons from the solids mixture;

(e) passing at least a portion of the separated volatilized hydrocarbons to the quench zone to directly contact agglomerative coal in the feed stream;

(f) withdrawing at least a portion of the carbon containing particulate solid residue as product; and (g) separating values from the residual uncondensed volatilized hydrocarbon stream by condensing hydrocarbons therefrom.

16. In a continuous process for recovery of values contained in a feed stream containing agglomerative coal in which a stream containing preheated agglomerative coal is pyrolyzed in a pyrolysis zone by contact with a particulate solid source of heat to yield a pyrolysis product stream containing condensible volatilized hydrocarbons and a carbon containing particulate solid residue; the improvement which comprises the step of:

directly combining in cocurrent, entrained, turbulent flow in a quench zone maintained at a temperature lower that the temperature in the pyrolysis zone and lower than the softening point of the agglomerative coal at least a portion of the feed stream with a stream containing volatilized hydrocarbons resulting from pyrolysis of the agglomerative coal to simultaneously preheat the feed stream and rapidly quench the volatilized hydrocarbons.

* * * * *

UNITED STATES PATENT AND TRADEMARK OFFICE

CERTIFICATE OF CORRECTION

PATENT NO. : 4,097,360

DATED : June 27, 1978

INVENTOR(S) : Stuart Sack

It is certified that error appears in the above-identified patent and that said Letters Patent are hereby corrected as shown below:

Col. 3, line 42, after "zone." delete the phrase "In the pyrolysis reaction zone."; line 58, for "temperatue" insert -- temperature --. Col. 5, line 13, after "condensed" delete ".". Col. 9, line 59, delete "conbining" and insert therefor -- combining --.

Signed and Sealed this

*Twenty-third* Day of *January 1979*

[SEAL]

*'est:*

RUTH C. MASON
*Attesting Officer*

DONALD W. BANNER
*Commissioner of Patents and Trademarks*